US005944487A

United States Patent [19]

Pearce

[11] Patent Number: 5,944,487

[45] Date of Patent: Aug. 31, 1999

[54] BLADE RING ATTACHMENT SYSTEM

[75] Inventor: Richard A. Pearce, Memphis, Tenn.

[73] Assignee: Hunter Fan Company, Memphis, Tenn.

[21] Appl. No.: 08/908,226

[22] Filed: Aug. 7, 1997

Related U.S. Application Data

[60] Provisional application No. 60/024,396, Aug. 9, 1996.

[51] Int. Cl.[6] ..... B63H 1/28

[52] U.S. Cl. ..... 416/244 R; 416/5; 29/889.3

[58] Field of Search ..... 416/5, 170 R, 416/204 R, 210 R, 244 R; 417/7, 423.1, 423.7; 29/889.3, 428, 525.04

[56] References Cited

U.S. PATENT DOCUMENTS

| | | | |
|---|---|---|---|
| D. 312,688 | 12/1990 | Mason . | |
| D. 323,384 | 1/1992 | Mason . | |
| D. 324,100 | 2/1992 | Holbrook . | |
| D. 325,776 | 4/1992 | Scofield et al. . | |
| D. 328,947 | 8/1992 | Holbrook . | |
| D. 346,209 | 4/1994 | Holbrook . | |
| D. 349,336 | 8/1994 | Tsuji . | |
| D. 354,804 | 1/1995 | Tsuji . | |
| D. 357,978 | 5/1995 | Young . | |
| D. 358,877 | 5/1995 | Tsuji . | |
| D. 361,377 | 8/1995 | Tsuji . | |
| D. 367,321 | 2/1996 | Holbrook . | |
| 3,551,070 | 12/1970 | Glucksman | 416/244 R |
| 4,511,310 | 4/1985 | Pearce | 416/5 X |
| 4,634,345 | 1/1987 | Stanek et al. | 416/244 R |
| 5,222,864 | 6/1993 | Pearce . | |
| 5,297,936 | 3/1994 | Sato | 416/244 R X |
| 5,304,037 | 4/1994 | Scofield . | |
| 5,462,412 | 10/1995 | Scofield et al. . | |
| 5,501,010 | 3/1996 | Scott | 29/889.3 |
| 5,593,283 | 1/1997 | Scott | 416/244 R X |

*Primary Examiner*—John E. Ryznic

*Attorney, Agent, or Firm*—Garrison, Morris & Haight, PLLC

[57] ABSTRACT

A ceiling fan blade attachment system for attaching a ceiling fan blade ring to a rotatable electric drive motor mounting surface. The blade ring and motor mounting surface include cooperating elements that enable the blade ring to be suspended adjacent to the motor mounting surface prior to fixed attachment of the blade ring to the motor mounting surface. The motor mounting surface includes a plurality of downwardly extending suspension posts. The blade ring includes a plate or bracket including keyhole shaped openings to receive the suspension posts and to enable rotation of the mounting ring so as to lock or suspend the blade mounting ring below the motor mounting surface in a provisional or temporary manner until the blade ring can be fixedly attached to the mounting surface.

18 Claims, 4 Drawing Sheets

BLADE RING ATTACHMENT SYSTEM

CROSS-REFERENCES

The subject application claims the priority benefits of U.S. Provisional Patent Application having Ser. No. 60/024,396 filed on Aug. 9, 1996, entitled: "Blade Ring Attachment System."

BACKGROUND 1.0 Field of the Invention

The invention relates to ceiling fans and to systems for attaching a blade mounting ring, to which the ceiling fan blades are attached, to a rotatable ceiling fan motor component. More particularly, the invention relates to a convenient system for suspending a blade mounting ring to the ceiling fan motor prior to final attachment of the blade mounting ring to the motor. That is, the installer can perform the blade mounting ring installation, with the ceiling fan blades secured thereto, without having to manually support the blade mounting ring assembly during the attachment procedure.

2.0 Related Art

Installation of a ceiling fan, and more particularly the attachment of ceiling fan blades to a mounted ceiling fan motor, is a cumbersome and time consuming process. Typically, the installation first requires attachment of the ceiling fan motor, and associated motor housing components, to the ceiling without the fan blades attached to the fan, followed by attachment of each of the fan blades to a rotatable component of the ceiling fan motor. Many systems and techniques for connecting the ceiling fan blades to the motor are known. For example, the ceiling fan blades may include blade irons having a typically arcuate mounting portion with screw holes to enable attachment of the blade irons to the motor component. Another type of system includes the attachment of blade ramps to the rotatable motor component and then securing each fan blade directly to each blade ramp. Each of these arrangements requires an installer to insert two or three screws for each fan blade while the fan blades are in an overhead position. The process can be strenuous and time consuming since there are typically four or five fan blades for a single ceiling fan.

U.S. Pat. No. 4,511,310, issued to Pearce, describes a ceiling fan where a blade mounting ring is attachable to a rotatable rotor portion of an electric motor. The blade mounting ring is annular in shape and includes a plurality of openings for receiving screws or bolts to attach the blade irons thereto. The blade ring also includes four arcuately shaped openings disposed about the periphery of the ring, with elastomeric grommets insertable in the arcuate openings. Threaded bolts are insertable through the grommets and screwed into threaded openings within the rotatable motor component. The blade ring is thus fixedly attached to the rotatable motor component for rotation therewith and is supported below the motor through the elastomeric grommets to thus isolate vibrations. Typically, the blade ring is attached to the motor prior to attachment of any of the fan blades to the ring, although sometimes an installer may first attach one or more of the ceiling fan blades to the blade ring and then raise the entire assembly to the underside of the ceiling fan motor so that the entire blade ring with attached blade assembly can be fastened to the motor. Each of these mounting techniques has several disadvantages.

For example, if the blade ring is first mounted to the rotatable motor component prior to attachment of the fan blades to the blade ring, the installer must first position the blade ring in alignment with the motor mounting holes with one hand in an overhead position, then insert each of the threaded bolts through the grommets, and then screw the bolts to the motor. Thereafter, each fan blade is separately attached to the ceiling-mounted blade ring. The number of separate mounting steps in an overhead position is extensive, particularly where four or five fan blades are attached. If, on the other hand, the installer tries to first attach the fan blades to the ring, prior to ring mounting, the installer must then raise the entire fan blade assembly and support the assembly with one hand while attempting to bolt or screw the blade ring to the motor component. Either method poses an extremely cumbersome and difficult procedure for the installer.

Thus, a need has arisen to provide an easier, quicker, less cumbersome and strenuous procedure to attach ceiling fan blades to a rotatable motor component of a ceiling fan.

SUMMARY

The present invention solves the problems of the prior art blade ring mounting systems through the use of a novel blade ring suspension system for suspending the blade ring. Each of the fan blades pre-attached to the blade ring of the present invention prior to attaching the blade ring to the fan motor. The installer simply raises the entire fan blade and blade ring assembly to the ceiling fan motor, and then with a simple insertion and twist can suspend the blade ring from the motor. Holes/openings in the blade ring are automatically aligned with openings in the motor mounting face so as to enable insertion of threaded bolts or screws through the openings for attachment to the motor mounting surface. The installer thus has both hands free to attach the blade ring to the motor mounting surface.

The novel blade ring suspension arrangement includes a generally annularly shaped blade ring having a blade ring mounting plate or bracket that faces the mounting surface of the rotatable motor component. At least two suspension posts extend from the motor mounting face, each of which include a blade ring supporting surface for supporting the blade ring mounting plate adjacent to and below the motor mounting face. The suspension post includes a threaded rod, preferably a screw or bolt, and an elastomeric surface surrounding the threaded rod and formed typically by a grommet. The elastomeric surface includes a groove that defines the blade ring support surface. A pair of keyhole-shaped openings are provided on the blade ring mounting plate or bracket so as to be complementary with the suspension posts. The suspension posts are insertable through the circular portions of the key-hole openings and then the blade ring is twisted or rotated in a direction toward the suspension posts so that each post rides in an elongated portion of the corresponding keyhole opening, whereby the mounting plate of the blade ring is inserted within the groove of each suspension post. The blade ring is thus supported by each of the suspension posts so the installer can attach the blade ring to the motor mounting surface using both hands.

The blade ring includes a plurality of attachment openings, each having an arcuate or circular shaped opening and a throat region opening toward the interior of the blade ring. In one preferred embodiment three attachment openings are included, with the attachment and key-hole openings being equidistantly spaced about the circumference of the blade ring mounting bracket. Elastomeric grommets are inserted within each of the open-throat openings. The blade ring is fixedly attached by inserting a screw or bolt through each attachment opening and the corresponding grommet, and threading the screws or bolts into aligned threaded holes in the motor mounting surface. After the blade ring is attached to the motor, rotation of the motor and motor mounting surface will rotate the blade ring without any relative movement between the blade ring and the motor mounting surface.

The present invention provides a convenient, quick, less cumbersome and strenuous system for attaching a blade ring assembly to a rotatable motor component of a ceiling fan motor. The ceiling fan blades may be attached to the blade ring prior to connection of the blade ring with the motor. The blade ring attachment system of the present invention enables attachment of the blade ring without having to manually support the blade ring to the rotatable motor portion during the final attachment process.

BRIEF DESCRIPTION OF THE DRAWINGS

These and other features, aspects, and advantages of the present invention will become better understood with regard to the following description, appended claims and accompanying drawings wherein:

DETAILED DESCRIPTION

Figure 1:
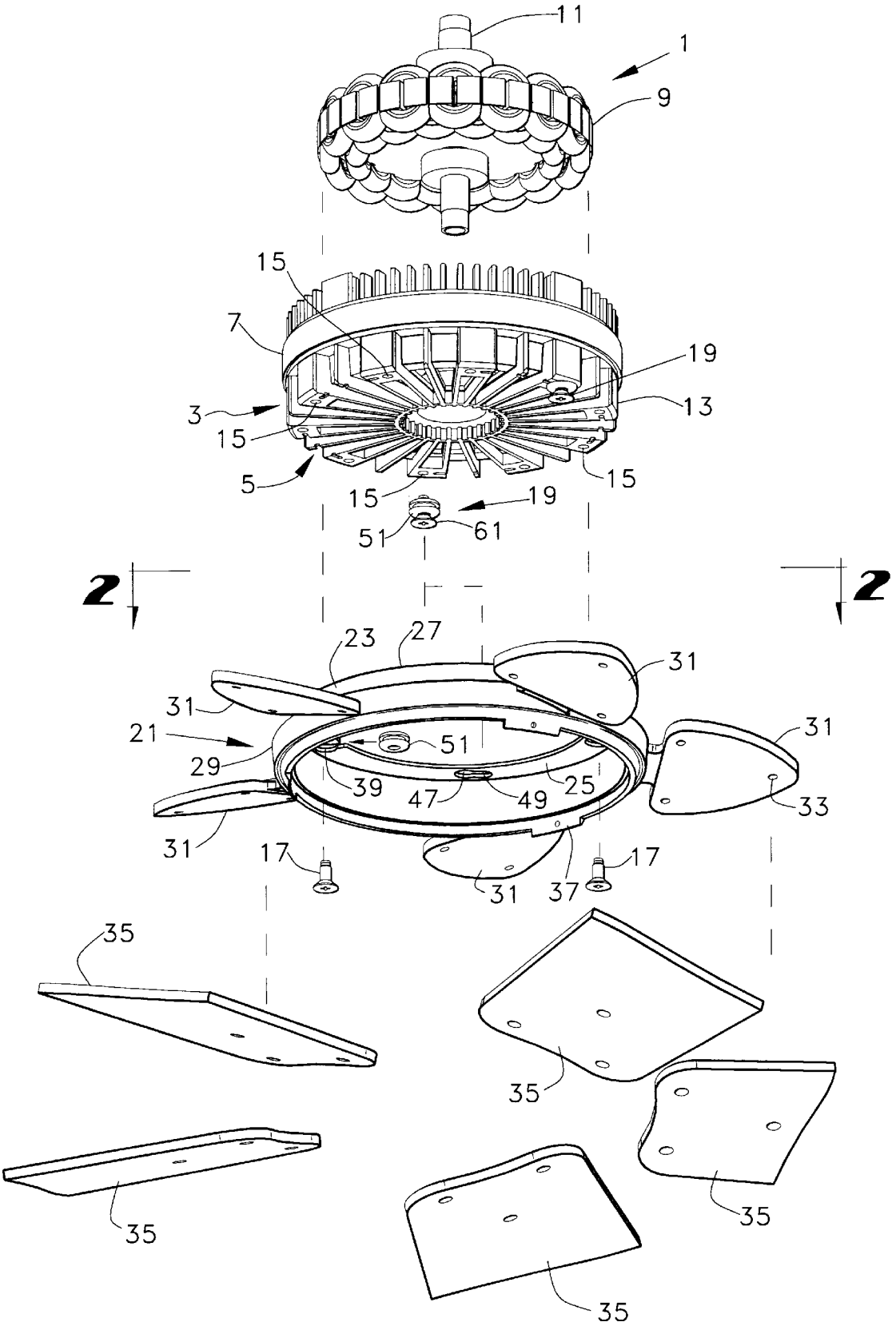
FIG. 1 is an exploded perspective view of a ceiling fan motor with the novel blade mounting ring of the present invention.

Referring now in more detail to the drawings, in which like numerals indicate like parts throughout the several views, a ceiling fan motor 1 is shown in exploded view and includes a rotatable motor portion 3 having a motor mounting surface or face 5. The motor 1 depicted in the drawings is an inside-out motor wherein the rotatable portion 3 is affixed to, or integral with, a rotor 7 that rotates about the stator 9, insertable within the motor housing or casing adjacent the rotor 7, and about a motor stator shaft 11. As is well known, the motor 1 is typically housed in a ceiling fan housing (not shown). The ceiling fan motor stator shaft 11 is typically threaded at its upper end and mounted to a down rod (not shown) which, in turn, extends through a canopy (not shown) mounted to the ceiling in a conventional manner. It should also be noted that the ceiling fan motor may be of the type where the statolr surrounds the rotor and the rotor rotates in the central region of the ceiling fan, as is shown in U.S. Pat. No. 4,511,310 issued to Pearce, which is expressly incorporated by reference herein in its entirety.

The inside-out motor 1 includes a bottom or lower motor casing portion 13 that is attached to, or cast integral with the rotor 7 and is rotatable therewith. The lower motor casing portion 13 includes the motor mounting surface 5. The motor mounting surface 5 includes a plurality of threaded holes 15 for receiving attachment screws, or bolts 17, (only two of which are shown) as well as suspension posts 19.

A blade ring 21 is disposed below the motor mounting face 5 and is fixedly attachable to the mounting face 5 to enable the blade ring 21 to be rotated with the rotatable lower motor casing portion 13 without any significant relative rotational movement therebetween. The blade ring 21 is a substantially annularly shaped structure having a first cylindrical portion 23 and an integral blade ring mounting surface or mounting plate or bracket 25. The bracket 25 extends inwardly from the edge 27 of the cylindrical portion 23 and is substantially planar. Integral with and below the first cylindrical portion 23 is a second annular substantially cylindrical portion 29. Integral with the second portion 29 are a plurality of ceiling fan blade mounting brackets 31 which preferably have a substantially triangular or heart-shaped profile. Preferably, five fan blade mounting brackets 31 are provided although the number may vary depending upon the ceiling fan design. The brackets 31 are oriented at slight angles with respect to the planar top mounting plate or bracket 25. Each of the brackets includes fan blade mounting holes or openings 33, preferably three for each bracket. Ceiling fan blades 35 are affixed to the underside of brackets 33 with screws or bolts (not shown). Although the brackets 33 are preferably integral with the blade mounting ring 21, the brackets 33 may be formed as separate structures that are screwed or bolted to the blade mounting ring 21. Alternatively, the ceiling fan blades could include conventional blade irons having arcuate shaped attachment members (not shown) that may be secured to the blade ring (in the manner similar to that shown in the Pearce patent or in any other conventional manner).

Extending from the bottom of the second cylindrical portion 29 of the blade ring 21 are a plurality of mounting tabs 37 for attaching a housing (not shown) to the bottom of the blade ring. The housing could encompass a switch mechanism, a light mechanism, or simply may be a convenient cover to enclose the bottom of the blade mounting ring for aesthetic purposes.

The blade ring mounting plate or bracket 25 includes a plurality of attachment openings 39 having generally arcuate or circular shaped openings 41 with a throat region 43 that opens toward the interior of the blade ring 21. (These attachment openings 39 may also be similar to those depicted in the Pearce patent). Preferably three attachment openings 39 are provided although the number may vary. The blade ring mounting bracket 25 further includes at least two key-hole shaped openings 45 disposed on opposite sides of at least one of the attachment openings. Preferably, openings 39 and 45 are equidistantly spaced about the circumference of the blade ring mounting bracket 25. The key-hole shaped openings 45 include a substantially circular opening portion 47 and a substantially elongated opening portion 49 which may extend substantially radially from the circular opening portion 47. Alternatively, the elongated portion 49 may have a slightly arcuate shape extending from the circular opening portion 47. These key-hole shaped openings 45 form part of the suspension system to suspend the blade ring adjacent to and below the motor mounting face in advance of fixedly attaching the blade ring to the motor mounting face, as will be described.

Figure 2:
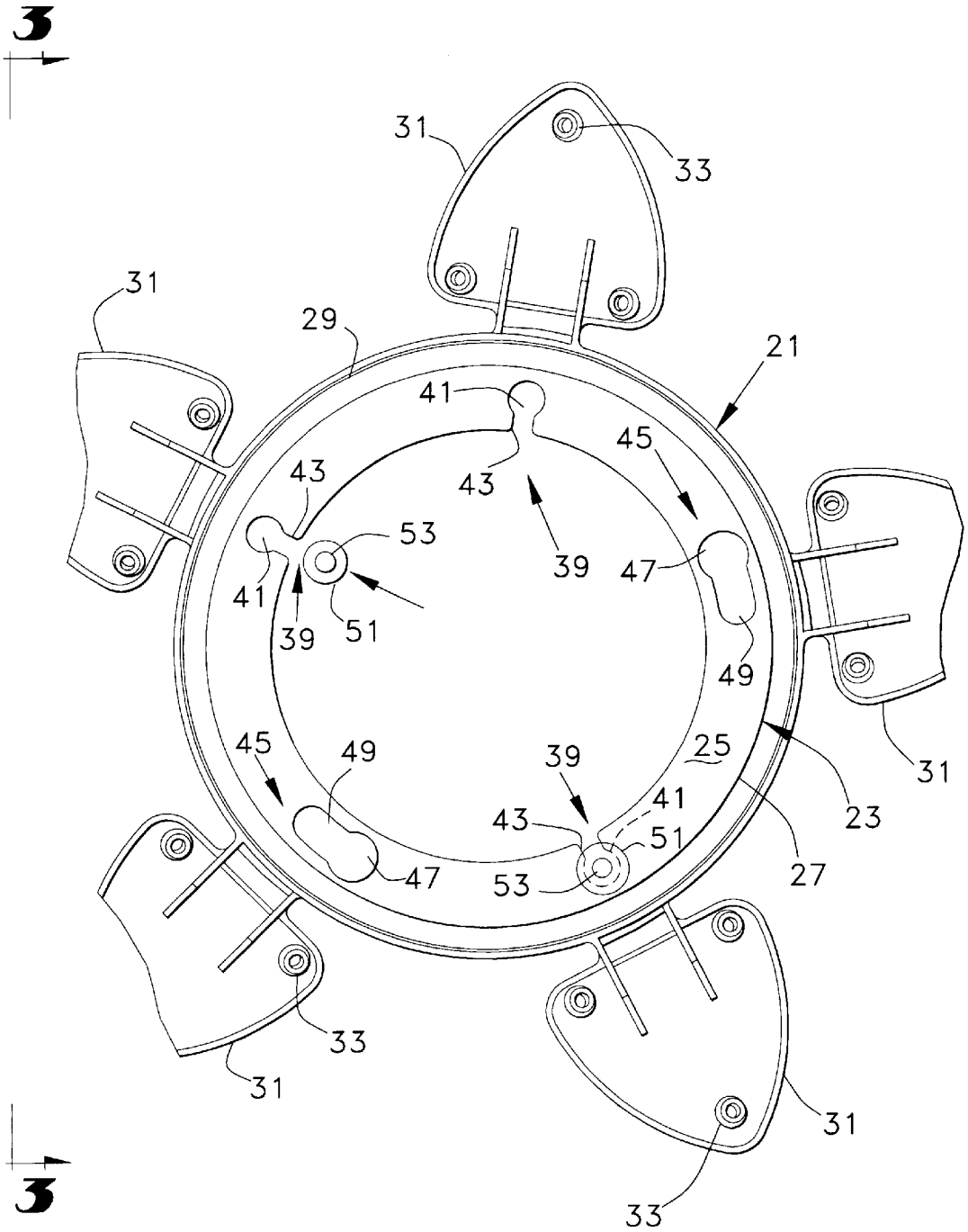
FIG. 2 is a top view of the blade mounting ring taken along line 2—2 of FIG. 1.
Figure 3:
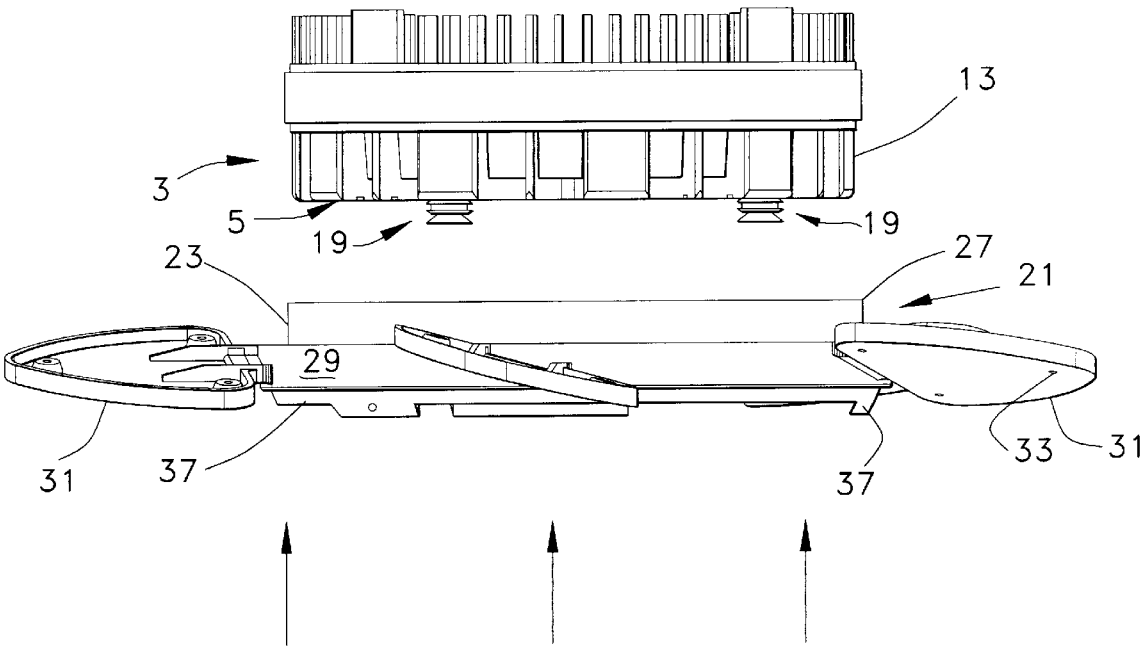
FIG. 3 is a side view of the blade mounting ring taken along line 3—3 of FIG. 2.
Figure 4A:
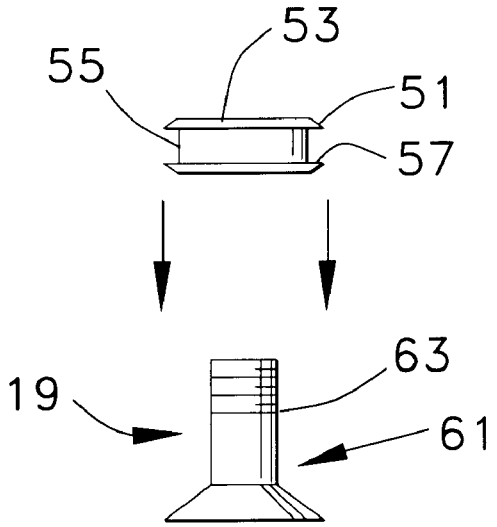
FIGS. 4A and 4B are side views of the suspension post screw and grommet.
Figure 4B:
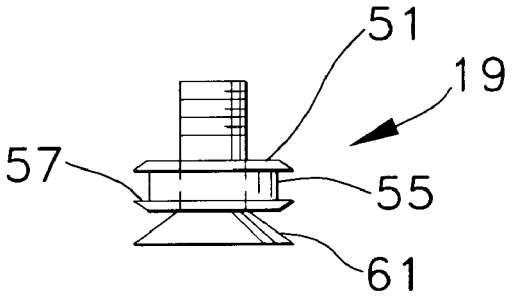

Inserted within each of the open-throat attachment openings 39 is a grommet 51 of elastomeric material, preferably rubber. The grommet 51 is substantially cylindrically shaped and has a through-hole opening 53 along the major axis of the grommet to receive one of the screws or bolts 17. Disposed substantially midway between the grommet ends is a groove 55 that extends from the outer circumferential region of the grommet inwardly so that the grommet may slide or pass through the open throat 43 of each attachment opening 39 and into the arcuate or circular region 41 whereby the blade ring mounting bracket 25 is received within the groove 55 and supported by a surface 57 defined by groove 55 and lying below the bracket 25. Although the grommet 51 is depicted as substantially cylindrical, it should be apparent that the outer dimensions of the grommet may vary and may be substantially rectangular as is shown in the Pearce patent. The axial through-hole 53 of each grommet is sized to receive one of the threaded bolts or screws 17 for fixed attachment to the motor mounting surface 5. Only two of three attachment grommets 51 are shown in FIG. 2.

The relative spacing of the attachment openings 39 on the blade ring mounting bracket 25 is to be complementary to the threaded holes or openings 15 on the motor mounting surface 5. Similarly, the location of the keyhole shaped openings 45 on the blade ring mounting surface plate or bracket 25 are complementary to the suspension posts 19 that extend from the bottom of the motor mounting face 5.

The suspension posts 19 include a threaded screw or bolt 61 that defines a threaded rod 63. The threaded rod 63 is surrounded by an elastomeric surface, preferably rubber, that is defined by an elastomeric grommet 51 preferably of the same size and overall shape and dimensions as the grommets that are inserted in the attachment openings 39. The suspension posts 19 are screwed into the blade ring motor mounting face openings 5 in advance of the blade ring mounting process and are preferably pre-attached to the motor mounting face 5 in advance of the ceiling fan installation. That is, the ceiling fan motor will preferably be delivered for attachment to the ceiling with the suspension posts 19 already threaded into the appropriate threaded openings 15 in the motor mounting face 5.

The diameter of the substantially circular portion or region 47 of the keyhole opening 45 is at least equal to, and preferably slightly larger than the cross-sectional dimension, or outside diameter, of the suspension post 19, including the substantially cylindrical elastomeric grommet 51. This enables the suspension post 19 to be easily insertable, in an axial direction, through the circular portion 47 of key-hole opening 45.

The elastomeric grommet 51 of the suspension post 19 also includes the annular groove 55 that defines the surface 57 which comprises a blade ring support surface for supporting the blade ring under and adjacent to the motor mounting face 5. The annular groove 55 extends from the outer cylindrical region of the suspension post 19 and inward toward the major axis of the suspension post a sufficient distance to enable the suspension post 19 to slide into the narrower elongated opening portion 49 such that the blade ring mounting bracket 25 is received by the annular groove 55 and a portion of the blade ring mounting bracket 25 faces and is supported by the surface 57 defined by the groove 55.

The suspension and subsequent attachment of the blade ring 21 to the motor mounting surface 5 will now be described. With the ceiling fan motor mounted to the ceiling, the suspension posts 19 extending from the motor mounting face 5 will be disposed in a direction substantially perpendicular to the motor mounting face 5. The installer of the ceiling fan then inserts the elastomeric grommets 51 into each of the three attachment openings 39 and also attaches each of the ceiling fan blades 35 to the ceiling fan brackets 31 on the blade mounting ring 21. This can be easily and conveniently done by attaching the ceiling fan blades 35 when the blade ring 21 is supported on the floor or a table. After the ceiling fan blades 35 are secured or affixed to the blade ring 25 and the elastomeric grommets 51 are inserted within each of the attachment openings 39, the entire blade ring assembly 21, with the ceiling fan blades 35 attached thereto, is raised by the installer toward the motor mounting face 5. Next the circular portions 47 of key-hole openings 45 are aligned with and inserted axially over the suspension posts 19 so the groove 55 of each grommet 51 is aligned, i.e. is at the same height as the blade ring mounting plate 25. The installer, after insertion, then rotates or twists the blade ring 21 in a direction so that the suspension posts 19 and included grommets 51 slide within the narrow elongated opening portions 49. The blade ring mounting plate 25 is captured by the groove 55 within the circumferential surface of each of the suspension posts 19. Once turned to a stopped position, the attachment holes or openings 39 of the blade ring 21 are aligned with the screw holes or openings in the bottom of the motor mounting face and the blade mounting ring 21 is suspended on the suspension posts 19 so the installer can insert the screws or bolts 17 with both hands free. Then, the installer inserts the screws or bolts 17 through the grommets 51 within the attachment openings 39 and tightens the screws or bolts 17 so that the blade ring 21 is fixedly secured to the rotatable motor mounting face 5. If necessary, the installer can also tighten the suspension posts 19 by screwing or rotating the threaded screws or bolts included in the suspension posts 19. Once fully assembled, the blade mounting ring 21 is fixedly secured to the rotatable motor mounting surface 5 and is supported by the elastomeric grommets 51 below the motor mounting surface 5. When the motor is turned on, the motor mounting face 5 rotates the blade ring 21 without any relative rotational movement therebetween (other than perhaps some incidental initial movement caused by deformation of the grommets during the acceleration phase).

It is thus seen that the blade mounting ring 21 may be quickly and easily attached to the rotatable motor mounting portion avoiding the cumbersome attachment process of the prior art arrangements which required the blade ring to be manually supported at the same time that the installer screws the attachment screws into the motor mounting face.

The foregoing detailed description of the present invention is to be clearly understood as being given by way of illustration and example only, the spirit and scope of the present invention being limited solely by the appended claims.

I claim:

1. In a ceiling fan having an electric drive motor defining a rotatable motor mounting face and a blade ring for attaching ceiling fan blades thereto, the blade ring including a mounting bracket and being fixedly attachable to said motor mounting face for rotation with the motor mounting face without relative movement between the motor mounting face and the blade ring, the improvement comprising:

a blade ring suspension means for freely suspending said blade ring adjacent said motor mounting face to enable fixation of said blade ring to said motor mounting face without having to manually support the blade ring adjacent the motor mounting face, said blade ring suspension means including at least two suspension posts extending from said motor mounting face, each of said suspension posts including an elastomeric surface and a blade ring support surface for supporting said blade ring mounting bracket adjacent to and below said motor mounting face, said blade ring support surface being defined by a groove in said elastomeric surface.

2. The ceiling fan of claim 1 wherein said blade ring mounting bracket including at least two openings for receiving said at least two suspension posts and for enabling said blade ring to be rotatable with respect to said motor mounting face prior to fixing said blade ring to said motor mounting face so that said blade ring support surface underlies a portion of said blade ring mounting bracket to support said blade ring mounting bracket.

3. The ceiling fan of claim 1 wherein said blade ring comprises a plurality of fan blade mounting brackets integral with said blade ring, each of said fan blade mounting brackets including blade attachment means for attaching ceiling fan blades thereto.

4. In a ceiling fan having an electric drive motor defining a rotatable motor mounting face and a blade ring for attaching ceiling fan blades thereto, the blade ring fixedly attachable to said motor mounting face for rotation with the motor mounting face without relative movement between the motor mounting face and the blade ring, the improvement comprising:

a blade ring suspension means for freely suspending said blade ring adjacent said motor mounting face to enable fixation of said blade ring to said motor mounting face without having to manually support the blade ring adjacent the motor mounting face;

wherein said blade ring includes a blade ring mounting bracket and wherein said suspension means includes at least two suspension posts extending from said motor mounting face, each of said suspension posts including a blade ring support surface for supporting said blade ring mounting bracket adjacent to and below said motor mounting face, said blade ring mounting bracket including at least two openings for receiving said at least two suspension posts and for enabling said blade ring to be rotatable with respect to said motor mounting face prior to fixing said blade ring to said motor mounting face so that said blade ring support surface underlies a portion of said blade ring mounting bracket to support said blade ring mounting bracket;

wherein each of said suspension posts include an elastomenic surface and wherein said blade ring support surface is defined by a groove in said elastomeric surface.

5. The ceiling fan of claim 4 wherein each of said suspension posts comprises a threaded rod threadingly engaging threaded holes in said motor mounting face.

6. The ceiling fan of claim 5 wherein said elastomeric surface is defined by an elastomeric grommet having an opening through which said threaded rod extends.

7. The ceiling fan of claim 6 wherein said threaded rod is a screw or bolt.

8. The ceiling fan of claim 4 wherein each of said openings in said blade ring mounting bracket includes a first opening portion to enable said suspension post to pass axially therethrough, and a second opening portion to enable said blade ring mounting bracket to rotate toward said suspension post whereby a portion of said blade ring mounting bracket is insertable within said groove.

9. The ceiling fan of claim 8 wherein each of said openings is a keyhole-shaped opening wherein said first opening portion is substantially circular and said second opening portion extends substantially radially therefrom.

10. A ceiling fan blade ring attachment system for attaching a ceiling fan blade ring to a rotatable electric drive motor mounting surface, said blade ring including a blade ring mounting plate, said ceiling fan including blade connection means for connecting ceiling fan blades to said blade ring, the attachment system including:

a pair of suspension posts extending from said motor mounting surface, each suspension post including a blade ring support surface;

a pair of key-hole shaped openings defined within said blade ring mounting plate, said key-hole shaped openings including a substantially circular portion and an elongated portion extending therefrom, said elongated portion having a width less than the diameter of said circular portion, wherein said suspension posts have a cross-sectional dimension not greater than the diameter of said substantially circular portion of said key-hole shaped opening so as to be insertable through said circular portion, and wherein said blade ring is arcuately displaceable relative to said motor mounting surface when said suspension post is inserted through said circular portion of said opening to enable said suspension post to slide within said elongated portion of said opening such that said blade ring support surface of said suspension post lies below said blade ring mounting plate and supports said blade ring mounting plate to suspend said blade ring below said motor mounting face; and means for threadingly attaching said blade ring to said motor mounting face when said blade ring is suspended below said motor mounting face so as to permit rotation of said blade ring with said motor mounting face without relative movement therebetween.

11. The attachment system of claim 10 wherein said means for threadingly attaching said blade ring to said motor mounting face comprises a plurality of fasteners.

12. A ceiling fan blade ring attachment system for attaching a ceiling fan blade ring to a rotatable electric drive motor mounting surface, said blade ring including a blade ring mounting plate, said ceiling fan including blade connection means for connecting ceiling fan blades to said blade ring, the attachment system including:

a pair of suspension posts extending from said motor mounting surface, each suspension post including a blade ring support surface;

a pair of key-hole shaped openings defined within said blade ring mounting plate, said key-hole shaped openings including a substantially circular portion and an elongated portion extending therefrom, said elongated portion having a width less than the diameter of said circular portion, wherein said suspension posts have a cross-sectional dimension not greater than the diameter of said substantially circular portion of said key-hole shaped opening so as to be insertable through said circular portion, and wherein said blade ring is arcuately displaceable relative to said motor mounting surface when said suspension post is inserted through said circular portion of said opening to enable said suspension post to slide within said elongated portion of said opening such that said blade ring support surface of said suspension post lies below said blade ring mounting plate and supports said blade ring mounting plate to suspend said blade ring below said motor mounting face; and attachment means for fixedly attaching said blade ring to said motor mounting face when said blade ring is suspended below said motor mounting face so as to permit rotation of said blade ring with said motor mounting face without relative movement therebetween;

wherein each of said suspension posts include a shaft extending downwardly from said motor mounting surface and an elastomeric surface defining said blade ring support surface.

13. The attachment system of claim 12 wherein said elastomeric surface is defined by a grommet surrounding said shaft.

14. The attachment system of claim 13 wherein said blade ring support surface is defined by an annular groove in said grommet.

15. The attachment system of claim 14 wherein said shaft is a screw or bolt shaft.

16. A ceiling fan blade ring attachment system for attaching a ceiling fan blade ring to a rotatable electric drive motor mounting surface, said blade ring including a blade ring mounting plate, said ceiling fan including blade connection means for connecting ceiling fan blades to said blade ring, the attachment system including:

a pair of suspension posts extending from said motor mounting surface, each suspension post including a blade ring support surface;

a pair of key-hole shaped openings defined within said blade ring mounting plate, said key-hole shaped openings including a substantially circular portion and an elongated portion extending therefrom, said elongated portion having a width less than the diameter of said circular portion, wherein said suspension posts have a cross-sectional dimension not greater than the diameter of said substantially circular portion of said key-hole shaped opening so as to be insertable through said circular portion, and wherein said blade ring is arcuately displaceable relative to said motor mounting surface when said suspension post is inserted through said circular portion of said opening to enable said suspension post to slide within said elongated portion of said opening such that said blade ring support surface of said suspension post lies below said blade ring mounting plate and supports said blade ring mounting plate to suspend said blade ring below said motor mounting face; and attachment means for fixedly attaching said blade ring to said motor mounting face when said blade ring is suspended below said motor mounting face so as to permit rotation of said blade ring with said motor mounting face without relative movement therebetween;

wherein said attachment means comprises:

a plurality of substantially arcuate openings within said blade ring mounting plate;

a plurality of elastomeric grommets each having a grommet opening for receiving a threaded screw or bolt shaft, each said grommet being inserted within one of said substantially arcuate openings.

17. A method for attaching ceiling fan blades to a ceiling-mounted rotatable motor mounting surface through a blade mounting ring that is fixedly attachable to the motor mounting surface, the blade mounting ring including means for attaching fan blades, the method comprising:

attaching a plurality of fan blades to the blade mounting ring;

raising the blade mounting ring with the attached fan blades to the ceiling-mounted motor mounting surface and connecting the blade mounting ring to the motor mounting surface so that the blade ring is freely suspended from the motor mounting surface; and fixedly attaching the blade mounting ring to said motor mounting surface as the blade ring remains freely suspended from the motor mounting surface.

18. A ceiling fan blade ring attachment system for attaching a ceiling fan blade ring to a rotatable electric drive motor mounting surface, said blade ring including a blade ring mounting plate, said ceiling fan including blade connection means for connecting ceiling fan blades to said blade ring, the attachment system including:

a pair of suspension posts extending from said motor mounting surface, each of said suspension posts including a shaft extending downwardly from said motor mounting surface, a blade ring support surface and an elastomeric surface defining said blade ring support surface;

a pair of key-hole shaped openings defined within said blade ring mounting plate, said key-hole shaped openings including a substantially circular portion and an elongated portion extending therefrom, said elongated portion having a width less than the diameter of said circular portion, wherein said suspension posts have a cross-sectional dimension not greater than the diameter of said substantially circular portion of said key-hole shaped opening so as to be insertable through said circular portion, and wherein said blade ring is arcuately displaceable relative to said motor mounting surface when said suspension post is inserted through said circular portion of said opening to enable said suspension post to slide within said elongated portion of said opening such that said blade ring support surface of said suspension post lies below said blade ring mounting plate and supports said blade ring mounting plate to suspend said blade ring below said motor mounting face.

* * * * *